US005572191A

United States Patent [19]

Lundberg

[11] Patent Number: 5,572,191

[45] Date of Patent: Nov. 5, 1996

[54] ARTICLE SECURITY ELEMENT

[75] Inventor: Peter Lundberg, Stockholm, Sweden

[73] Assignee: Esselte Meto International GmbH, Heppenheim, Germany

[21] Appl. No.: 214,826

[22] Filed: Mar. 17, 1994

[30] Foreign Application Priority Data

Mar. 19, 1993 [DE] Germany ..... 43 08 750.7

[51] Int. Cl.[6] ..... G08B 13/14

[52] U.S. Cl. ..... 340/572; 70/57.1; 340/551

[58] Field of Search ..... 340/572, 551; 70/57.1; 29/602.1

[56] References Cited

U.S. PATENT DOCUMENTS

| | | | |
|---|---|---|---|
| 3,665,449 | 5/1972 | Elder et al. | 340/572 |
| 4,074,249 | 2/1978 | Minasy | 340/572 |
| 4,298,862 | 11/1981 | Gregor et al. | 340/572 |
| 4,342,904 | 8/1982 | Onsager | 340/572 |
| 4,449,115 | 5/1984 | Koerner | 340/551 X |
| 4,581,524 | 4/1986 | Hoekman et al. | 340/572 X |
| 4,829,288 | 5/1989 | Eisenbeis | 340/551 |
| 4,899,134 | 2/1990 | Wheeless, Jr. | 340/572 X |
| 5,008,649 | 4/1991 | Klein | 340/572 |
| 5,022,244 | 6/1991 | Charlot | 70/57.1 |
| 5,069,047 | 12/1991 | Lynch et al. | 70/57.1 |

FOREIGN PATENT DOCUMENTS

| | | |
|---|---|---|
| 0123557 | 10/1984 | European Pat. Off. . |
| 0319248 | 6/1989 | European Pat. Off. . |
| 0455577 | 11/1991 | European Pat. Off. . |
| 3741780 | 6/1989 | Germany . |

*Primary Examiner*—Thomas Mullen
*Attorney, Agent, or Firm*—Nils H. Ljungman and Associates

[57] ABSTRACT

An article security element is provided which, regardless of its orientation in relation to a scanning field irradiated by a transmitter coil, can generate a response field which can be reliably detected by a receiver coil. The article security element preferably has a soft magnetic metal strip which is wound about an oblong, column-shaped base body at a winding angle which has a value between about 30 degrees and about 60 degrees with respect to the longitudinal axis of the base body.

20 Claims, 7 Drawing Sheets

ARTICLE SECURITY ELEMENT

BACKGROUND OF THE INVENTION

1. Field of the Invention

This invention relates to an article security element for being fastened to an article to protect the article against theft. Such security elements are typically used by retail outlets, especially clothing stores, to protect the clothing from being stolen. More particularly, the present invention relates to security elements which have at least one soft magnetic metal strip that is capable of being detected in a high-frequency electromagnetic field that is disposed, for example in a an exit doorway of a retail establishment.

2. Background Information

Article security elements of the type noted above are disclosed in particular in European Patent No. 0 123 557, which corresponds to U.S. Pat. No. 4,581,524. This publication discloses a security tag having several layers, in which a strip of soft magnetic metal is glued on a strip-shaped base layer. A cover layer, also in the form of a strip, is glued over the base layer and the strip of soft magnetic material. In this manner, an oblong security tag is constructed which is fastened to articles, e.g. textiles, which are to be protected against theft.

For detection of such a device, a security gate or door having both a transmitter coil to emit a high-frequency electromagnetic scanning field, and a receiver coil for measuring a response field emitted by the security label as a reaction to the scanning field can be positioned at the exit of the store. Then, if an attempt is made to carry an article protected in this manner through the exit, a theft alarm can be activated.

The strength of the response field emitted by the security tag is a function of the orientation of the security tag in relation to the scanning field. If the strip of soft magnetic material has the same orientation as the scanning field, so that the magnetic axis of the strip lies parallel to the direction of the scanning field, the entire strip can be remagnetized at the frequency of the scanning field, and the strip can therefore emit an electromagnetic response field, which can be detected by a magnetic field sensor designed as a receiver coil. If the strip, and thus also its "easy" axis of magnetization, are at a right angle to the scanning field, this scanning field cannot remagnetize the strip, and the strip essentially will not emit any detectable response field, and the stolen article might not be detected by the receiver coil.

OBJECT OF THE INVENTION

The object of the present invention is therefore to create an article security tag which, regardless of its orientation in relation to a scanning field emitted by a transmitter coil, can generate a response field which can be reliably detected by a receiver coil.

SUMMARY OF THE INVENTION

The invention teaches that this object can be achieved if the soft magnetic metal strip is preferably wound in the form of a helical line around an oblong, column-shaped base body made of a non-magnetic material with an angle of pitch between about 30 degrees and about 60 degrees. Therefore, in essentially any position of the article security element, a portion of the metal strip will be at an angle in relation to the scanning field, which angle will thus be less than or equal to about 60 degrees. This angle has been found by testing to be the angle of a metal strip in relation to a scanning field at which the metal strip can be remagnetized, and thereby emit a response field which has the highest probability of being detected by a magnetic field sensor. Likewise, any portion of the strip which is disposed at an angle of greater than about 60° will generally not produce a sufficient electromagnetic response field to be detectable.

A response field which can be reliably detected can be emitted by the metal strip if the angle of pitch (alpha) is preferably between about 40 degrees and about 50 degrees, and has, for example, a value of about 45 degrees.

A base body, preferably designed in the form of a cylinder, a hollow cylindrical body, or a tube, can essentially make possible a simple and efficient manufacture of the article security element as claimed by the present invention, using a type of lathe in which the cylindrical body can be chucked, and then wound with the magnetic strip.

A base body for the soft-magnetic metal strip, which has the shape of a rectangular solid, can also typically be manufactured simply and economically by obtaining an oblong strip of non-magnetic material having an adequate thickness, and then cutting off portions of the strip to form the base body.

Experiments have shown that the article security element in accordance with the present invention can emit a strong response field which can be reliably detected if the metal strip winding of the article security element preferably has one turn about the element, or, alternatively if the article security element has at least two metal strips forming two half-turns about the element. In the case of two metal strips, the strips should preferably be wound in opposite direction to one another and in a spiral pattern on the base body, thereby providing portions of the strip in the above-discussed angular configurations that are needed to essentially allow detection of the device to occur in any position of the device.

An article security element which is particularly useful to protect textiles against theft can be obtained if the base body preferably has a hollow interior, and in the interior thereof there can preferably be a locking device for receiving a pin to thereby fasten the article security element to the article to be protected against theft. As a result of the use of the pin, the article security element can be very easily fastened to the textiles to be protected against theft.

In essence, the simplest concept which is presented by the present invention, is that there is at least one magnetic axis of the magnetic strip in each of the three spatial directions, that is, the x-dimension, the y-dimension, and the z-dimension, so that, no matter what the orientation of the object to which the magnetic strips are applied, at least one portion of the magnetic strips should be able to be detected. Further, even if the device according to the present invention had at least one magnetic axis in only two directions, i.e. the x-dimension and the y-dimension, the number of undetectable positions of such a device in a scanning/detection field is significantly reduced over a single-dimensional strip of magnetic material.

In summary, one aspect of the invention resides broadly in an anti-theft device for use in an electro-magnetic surveillance system for protecting an article from being stolen. The anti-theft device comprises a base body having a longitudinal axis and a perimeter surface about the longitudinal axis, and at least one strip of soft magnetic material disposed on the perimeter surface of the base body, wherein the at least one strip of soft magnetic material is helically disposed about the perimeter surface at an angle of pitch of between about 30° and about 60° with respect to the longitudinal axis.

Another aspect of the invention resides broadly in an anti-theft device for use in an electro-magnetic surveillance system for protecting an article from being stolen, wherein the anti-theft device comprises: a body, and apparatus for disposing the body to accompany an article to be protected upon movement of the article. The body comprises magnetic means, and the magnetic means comprises at least a first portion and a second portion, wherein the first portion and the second portion each comprise a magnetic material. The first portion and the second portion each have macroscopic dimensions, and the first portion and the second portion each define a magnetic axis, wherein the magnetic axis of the first portion is disposed in a non-collinear relationship with the magnetic axis of the second portion.

Still another aspect of the invention reside broadly in a method for protecting an article from being stolen, the method comprising the steps of: providing apparatus for detecting a magnetic field, the apparatus for detecting a magnetic field being configured to detect a magnetic field in an area through which the article can be taken; disposing an anti-theft device to accompany an article to be protected upon movement of the article; configuring the anti-theft device to comprise a body having at least a first portion and a second portion, the first portion and the second portion each comprising a magnetic material and each defining a magnetic axis, with the magnetic axis of the first portion being disposed in a non-collinear relationship with the magnetic axis of the second portion, wherein each magnetic axis generates a corresponding magnetic field, and apparatus for disposing the body to accompany the article upon movement of the article; moving the protected article into the area; and detecting, upon entry of the anti-theft device into the area, the at least one magnetic field of at least one of the magnetic axis of the first portion, and the magnetic axis of the second portion.

BRIEF DESCRIPTION OF THE DRAWINGS

Several embodiments of the invention are explained in greater detail below, with reference to the accompanying figures, in which.

DESCRIPTION OF THE PREFERRED EMBODIMENT

Figure 1:
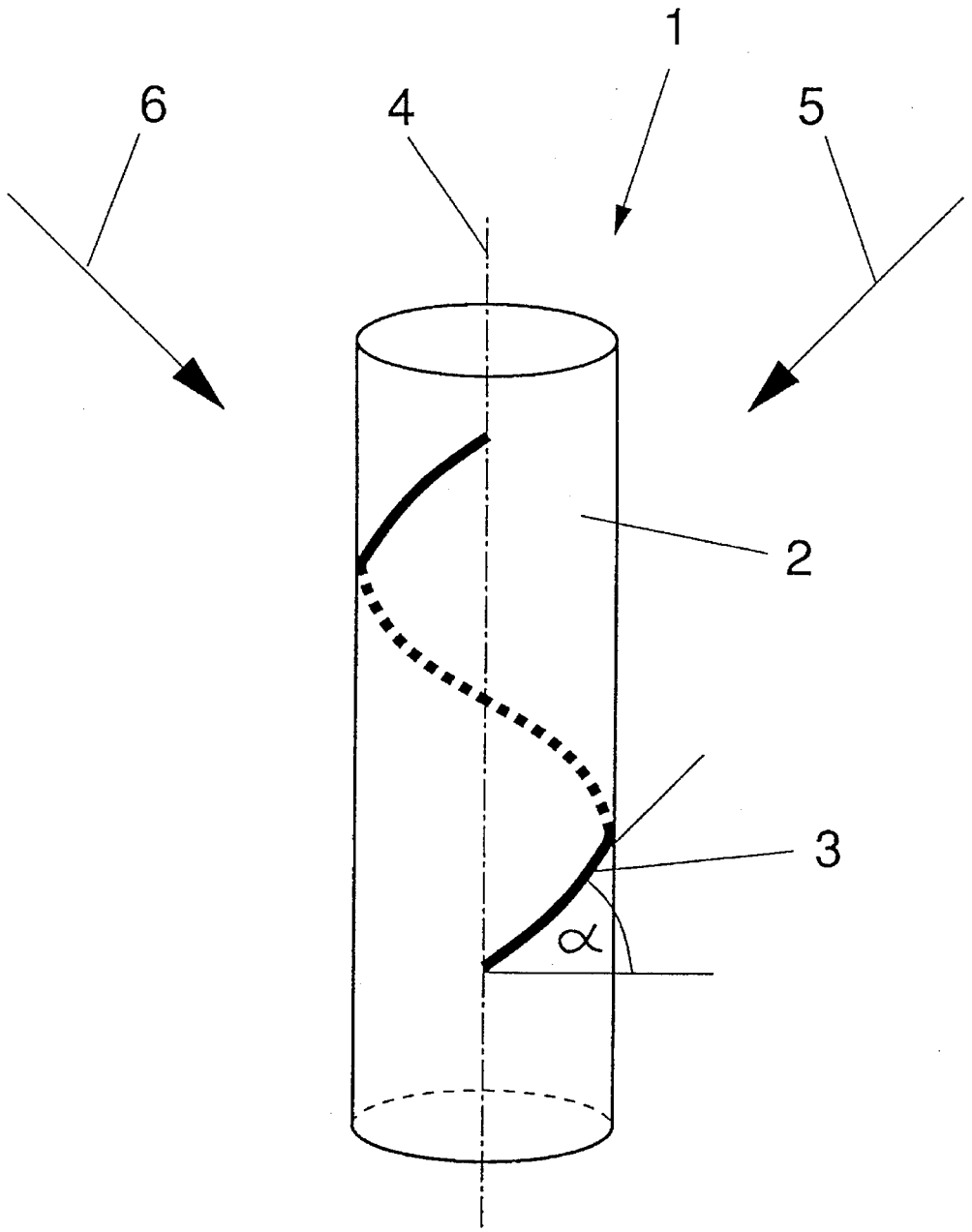
FIG. 1 shows an article security element having a cylindrical base body having one turn of a soft magnetic metal strip wound therearound in a spiral fashion.
Figure 1A:
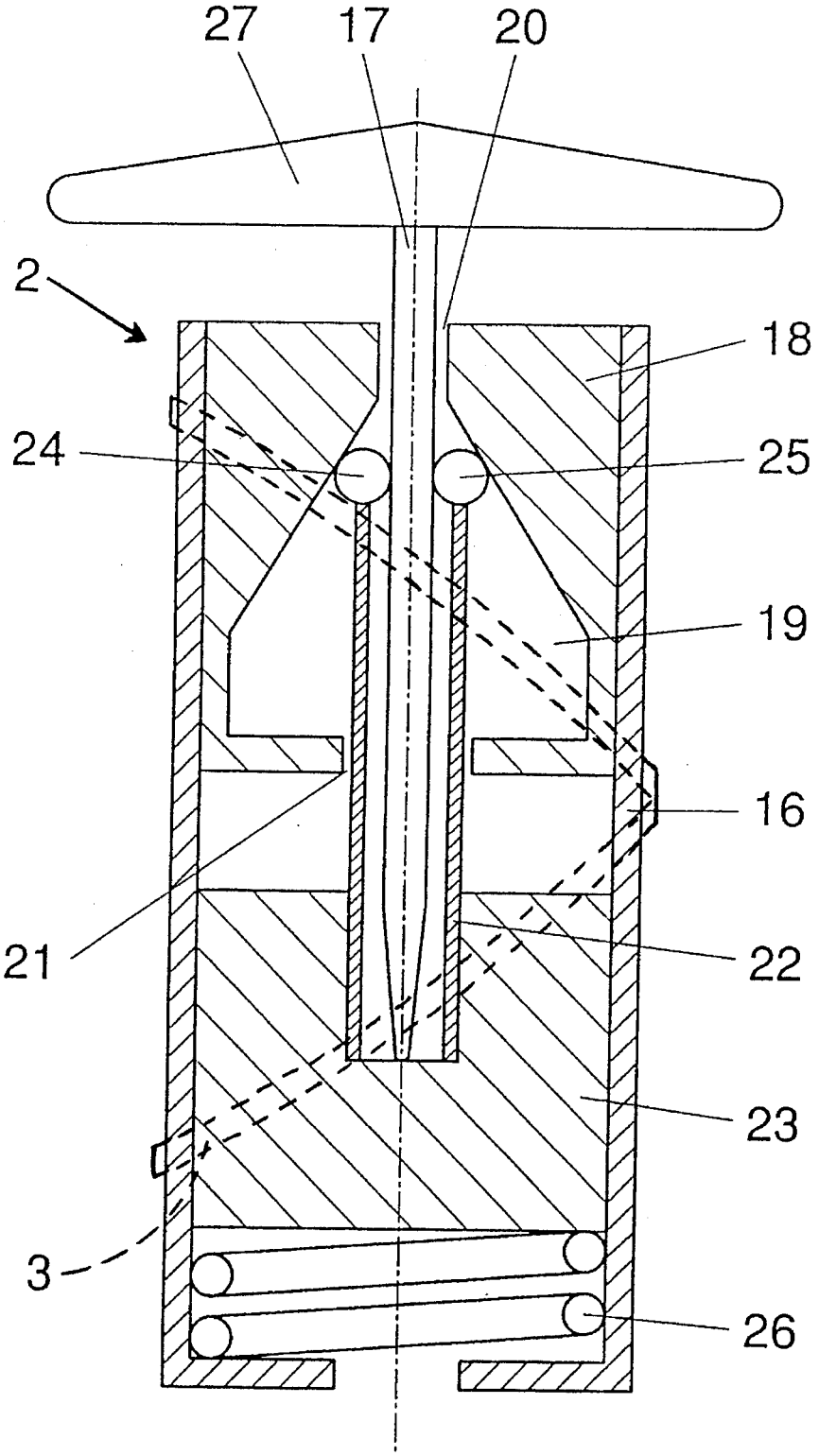
FIG. 1*a* shows an article security element having a strip of soft magnetic material disposed thereabout and a locking device disposed therewithin.

An article security element in accordance with the present invention, as illustrated in FIGS. 1 and 1*a*, can preferably have a cylindrical base body 2 made of a non-magnetic material, e.g. plastic, which can be designed as a solid body, a hollow body or a tube. The embodiments of the base body illustrated in FIGS. 1 to 5 are designed as solid bodies. A soft magnetic metal strip 3, which can preferably be from at least one of: a ferrite metal or a nickel-iron alloy, for example, can preferably be wound in a spiral fashion onto the base body 2, and fixed to the base body 2 by means of an adhesive attachment. Some examples of materials which can be used for the magnetic strip 3, and examples of particular configurations of the magnetic strip 3 are discussed further herebelow.

In the illustrated embodiment of FIG. 1, the strip winding 3 preferably has one turn, and in this embodiment can have an angle of lead of (alpha)=about 45 degrees from horizontal. Consequently, and regardless of the direction in which a high-frequency electromagnetic scanning field acts on the article security element 1, a portion of the metal strip winding 3 can always be at an angle which is less than or equal to about 45 degrees in relation to the scanning field. If the orientation of the scanning field is, for example, parallel or perpendicular to the axis of symmetry 4 of the base body 2, essentially the entire metal winding strip 3 can be at an angle of about 45 degrees in relation to the scanning field. If, for example, the article security element 1 is oriented so that a scanning field acts on the element 1 in the direction indicated by arrow 5, the angle between the beginning and the end of the metal winding strip 3 and the field 5 can be practically about 0 degrees. Alternately, if a scanning field acts on the article security element 1 in the direction indicated by arrow 6, the middle portion of the metal winding strip 3 indicated in broken lines in FIG. 1 can be at an angle of approximately 0 degrees in relation to the field 6.

It can generally be understood that a strip of magnetic material, such as the strip 3, as described above, will have a magnetic axis extending from a north pole to a south pole. Thus, if a strip of weak magnetic material having a defined magnetic axis is placed in a stronger alternating magnetic field, the magnetic field of the strip can be caused to alternate, or the magnetic poles of the strip of material can even be caused to reverse, thereby causing the magnetic axis of the strip to also reverse itself with each alternation. Such a reversal can then be detected by scanning devices which are known in the art. In the simplest sense, one embodiment of the present invention provides that an area through which articles are taken be provided with means for detecting a magnetic field, such that when a strip of magnetic material is carried into the area, and the magnetic field is detected, an alarm can be sounded. Some examples of configurations which can be used for scanning and detecting the magnetic strip 3 are discussed further herebelow.

The angle at which the magnetic strip is disposed is of particular importance, because tests have shown that a straight strip of soft magnetic metal which is at an angle of more than about 60 degrees in relation to the connecting line between a transmitter coil and a receiver coil of an article security system will probably not activate a theft alarm if the strip is irradiated with a high-frequency electromagnetic scanning field, but there is a high probability that the alarm will be activated if this angle is less than about 60 degrees. It has also been shown that such an alarm can essentially be tripped with absolute certainty if this angle has a value between about 40 degrees and about 50 degrees, e.g. about 45 degrees.

The helical orientation of the metal strip winding 3 on a base body 2 at an angle of lead of (alpha)=about 45 degrees therefore means that, regardless of the position of the article security element 1 in relation to a scanning field, there will typically always be a portion of the metal strip 3 which is at an angle of about 45 degrees or less in relation to the scanning field, and thus an alarm will be reliably activated if an attempt is made to steal an item tagged with the article security element 1 configured in accordance with the present invention.

Figure 2:
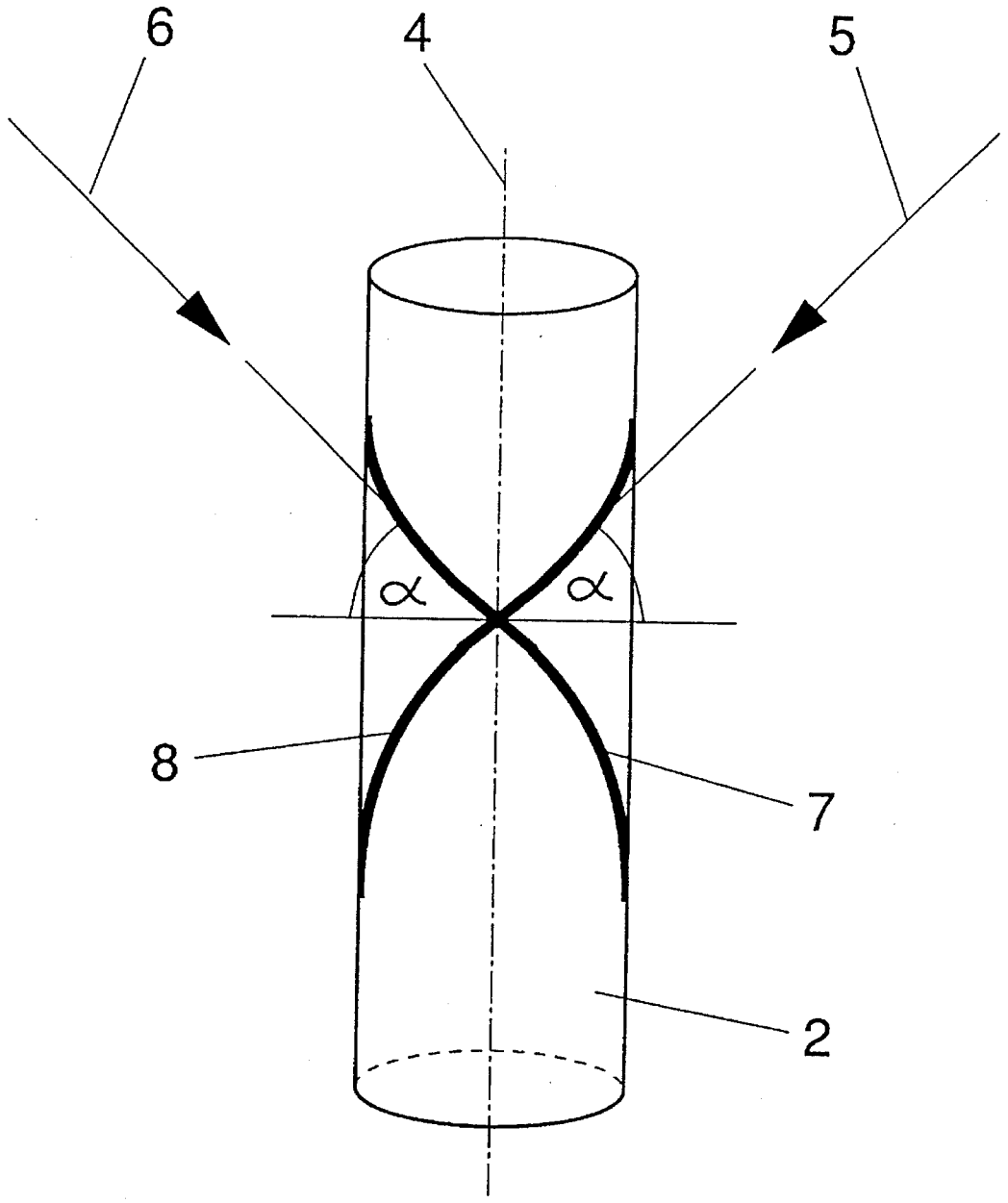
FIG. 2 shows an article security element having the same shape as illustrated in FIG. 1, wherein the metal strip is applied as a winding having two half-turns.

The same effect can essentially be achieved if the metal strip, as shown in FIG. 2, is preferably designed as a winding with two half-turns 7 and 8 which can preferably be wound around the base body 2 in opposite directions, but still in a helical manner at an angle of lead of about 45 degrees. If the half-turns 7 and 8 touch or cross one another, they can thus form an angle of about 90 degrees with one another.

Here, too, the two turns 7 and 8 can essentially always have at least one portion which will typically be at an angle of about 45 degrees, or less, in relation to an electromagnetic scanning field which is parallel, or perpendicular, to the axis of symmetry 4, so that both turns 7, 8 can react actively to such a field and activate an alarm. On the other hand, a field which is parallel to the arrow 5 can generally act only on the turn 8, and a field in the direction of the arrow 6 can generally act only on the turn 7, so that the metal strips are remagnetized by the scanning field and activate the theft alarm. Again, with such a configuration, no matter what the orientation of the base body 2, there will generally always be a portion of the magnetic strip which is at an angle of less than about 60° with respect to the scanning field.

In returning to the general discussion of magnetic poles as briefly mentioned above, a strip of magnetic material can preferably be understood to have a large number of north and south poles disposed in substantial alignment with one another in a longitudinal dimension of the strip. In other words, no matter where such a strip would be cut, the pieces resulting from the cutting would each form an individual magnetic strip. This concept can conceivably be true to the atomic level at which individual north and south atoms are realized.

The present invention is not meant, however, to be viewed from an atomic level, but on the other hand, at at least a macroscopic level of magnitude wherein at least a number of north-south dipoles are generally aligned to form a macroscopic strip of material, and can be said to essentially define a single magnetic axis. In view of this, by providing a helical winding of a strip of magnetic material about a body, a number of non-aligned magnetic dipoles, or axes, can result. In the case of a cylindrical element, this number can be quite large, while for a rectangular object there can at least be one different magnetic axis on each side of the rectangle.

Thus, in accordance with one embodiment of the present invention, by providing at least two non-aligned magnetic axes on a body (axes in two-dimensions), rather than a single magnetic axis as has previously been done, the chances of being able to move such a body through a scanning/detection field undetected are greatly diminished, especially if the angle between the two magnetic axes is preferably between about 30 degrees and about 150 degrees. The two magnetic axes can, in essence, be disposed in a same plane, whereby the two axes might intersect one another if the magnetic material forming the two axes overlaps. Alternatively, the magnetic material forming the two axes could be disposed spatially with respect to one another, that is, the two magnetic axes could each define a plane, and the planes could be spaced apart from one another, and parallel to one another.

Taking the above concept even further, that is, by disposing a magnetic axis also in the third dimension, one embodiment of the present invention can essentially provide the elimination of any possibility of moving such a protected object through a scanning/detection field, especially if the angle of the third magnetic axis is between about 30 degrees and about 150 degrees with respect to the two dimensional planes formed by the first two magnetic axes as described above. In other words, if the first magnetic axis is disposed in a first, or x-dimension, and the second is then disposed at an angle to the first to define a single x-y plane, or spaced apart parallel x-y planes, the third axis should preferably be at an angle to the x-y plane (or planes), thereby extending into the z-direction. In essence, it could be preferable that each of the first, second and third magnetic axes be disposed at about 90° with respect to one another.

In essence, the device as described immediately hereabove, would require the positioning of three individual strips of magnetic material on a base object. Therefore, in order to simplify construction of such a security element, and eliminate the need for positioning three separate strips of magnetic material, one embodiment of the present invention provides that a strip of magnetic material can preferably be wound helically about a solid body, with an angle of pitch of between about 30 degrees to about 60 degrees. Such an angle of pitch can essentially provide the angular relationship of the magnetic axes as discussed above.

Figure 3:
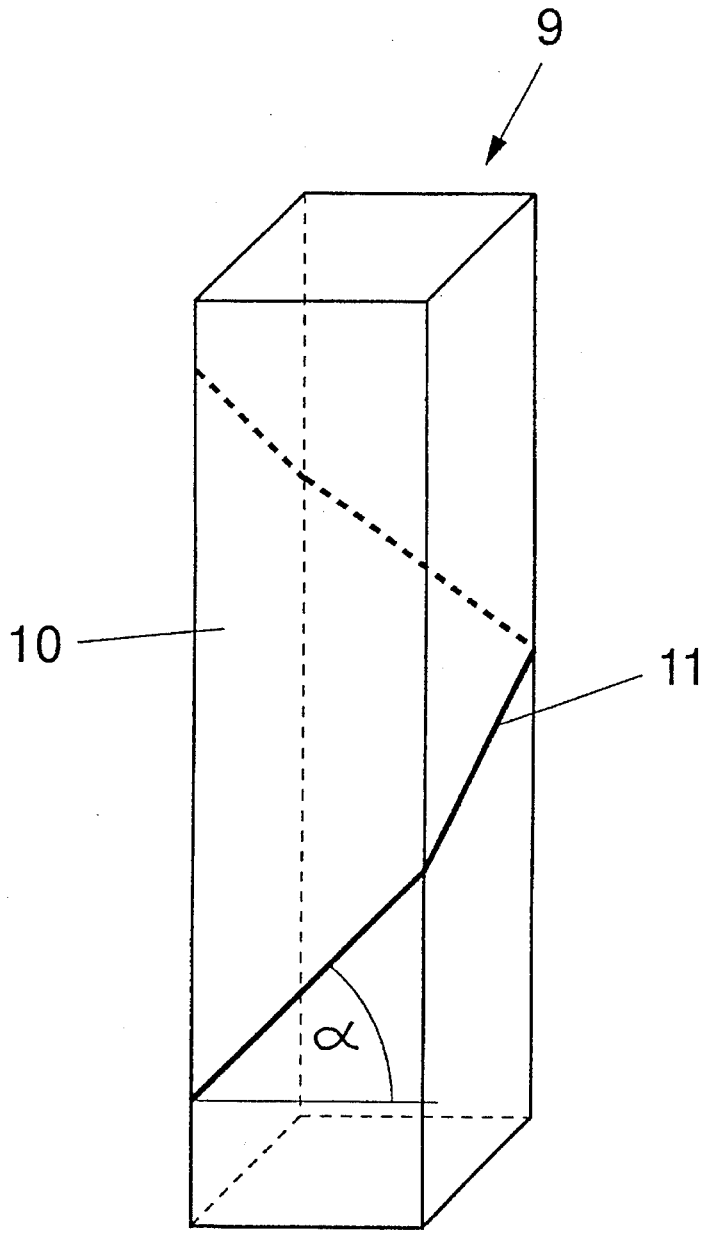
FIG. 3 shows an article security element with a rectangular base body and having one turn of a soft magnetic metal strip wrapped therearound.

FIG. 3 shows an embodiment of an article security element 9 having a rectangular base body 10. Such a rectangular base body can be manufactured by cutting, e.g. sawing, the corresponding pieces from an endless strip of plastic or other non-magnetic material having an adequate thickness. The soft magnetic metal strip 11 can also preferably be located on this base body 10 as a helical winding having an angle of lead of (alpha) between about 30 degrees and about 60 degrees, and preferably about 45 degrees.

Figure 4:
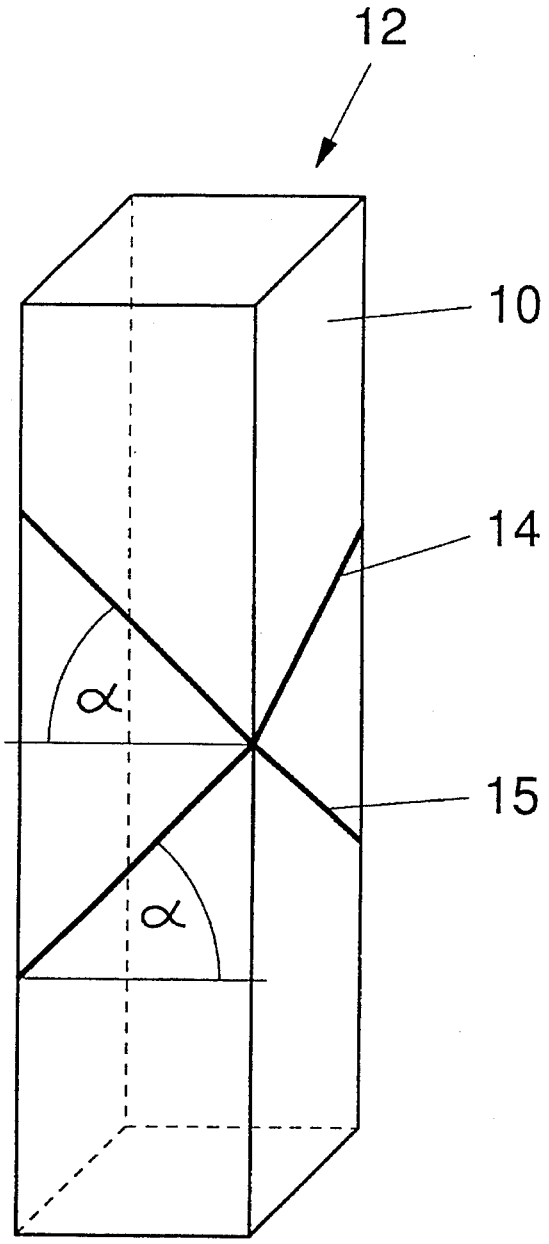
FIGS. 4 and 5 show article security elements as illustrated in FIG. 3 with metal strip windings having two half-turns which are applied to base bodies in the form of rectangular solids.
Figure 5:
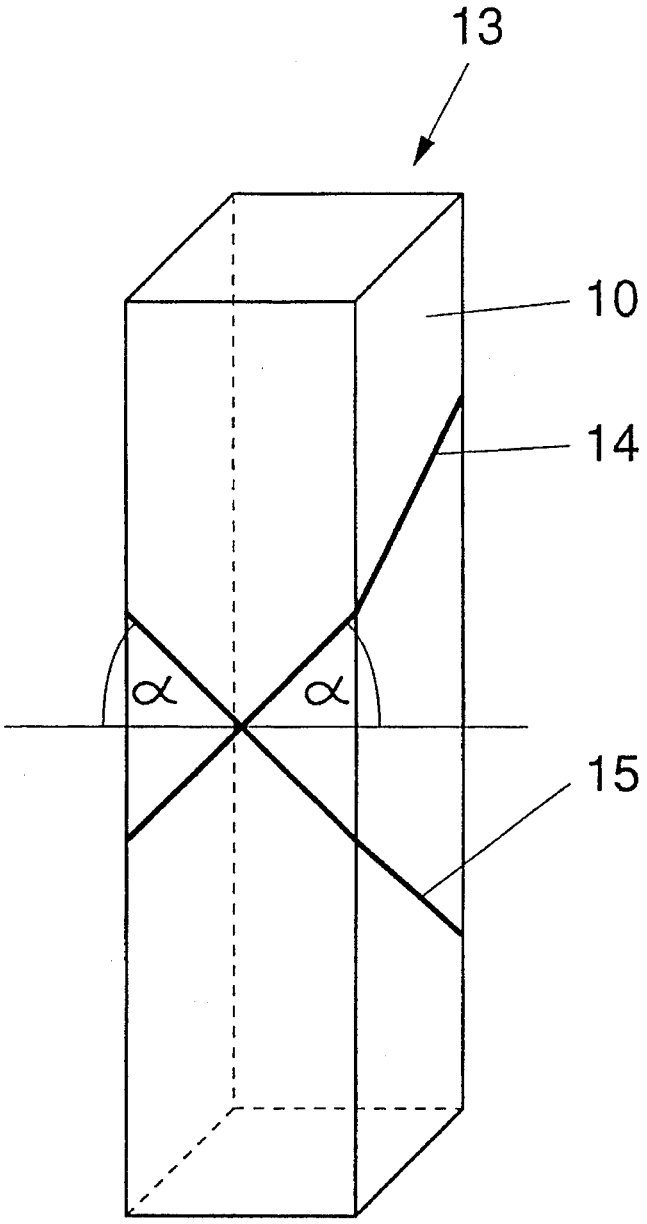

FIGS. 4 and 5 illustrate embodiments 12 and 13 of the article security element in which the soft magnetic metal strip is configured as a soft magnetic winding having two half-turns 14 and 15, each preferably disposed at an angle of lead of (alpha) between about 30 degrees and about 60 degrees, preferably about 45 degrees, on the base body 10 which can be in the form of a rectangular solid. The embodiments 12 and 13 differ from one another in that the turns 14 and 15 in the embodiment 12 cross on a corner of the base body 10, and in the embodiment 13 they cross on its front surface. An alternate embodiment, while not shown, could have the turns 14 and 15 disposed on the base body 10 in a non-crossing relationship.

Figure 6:
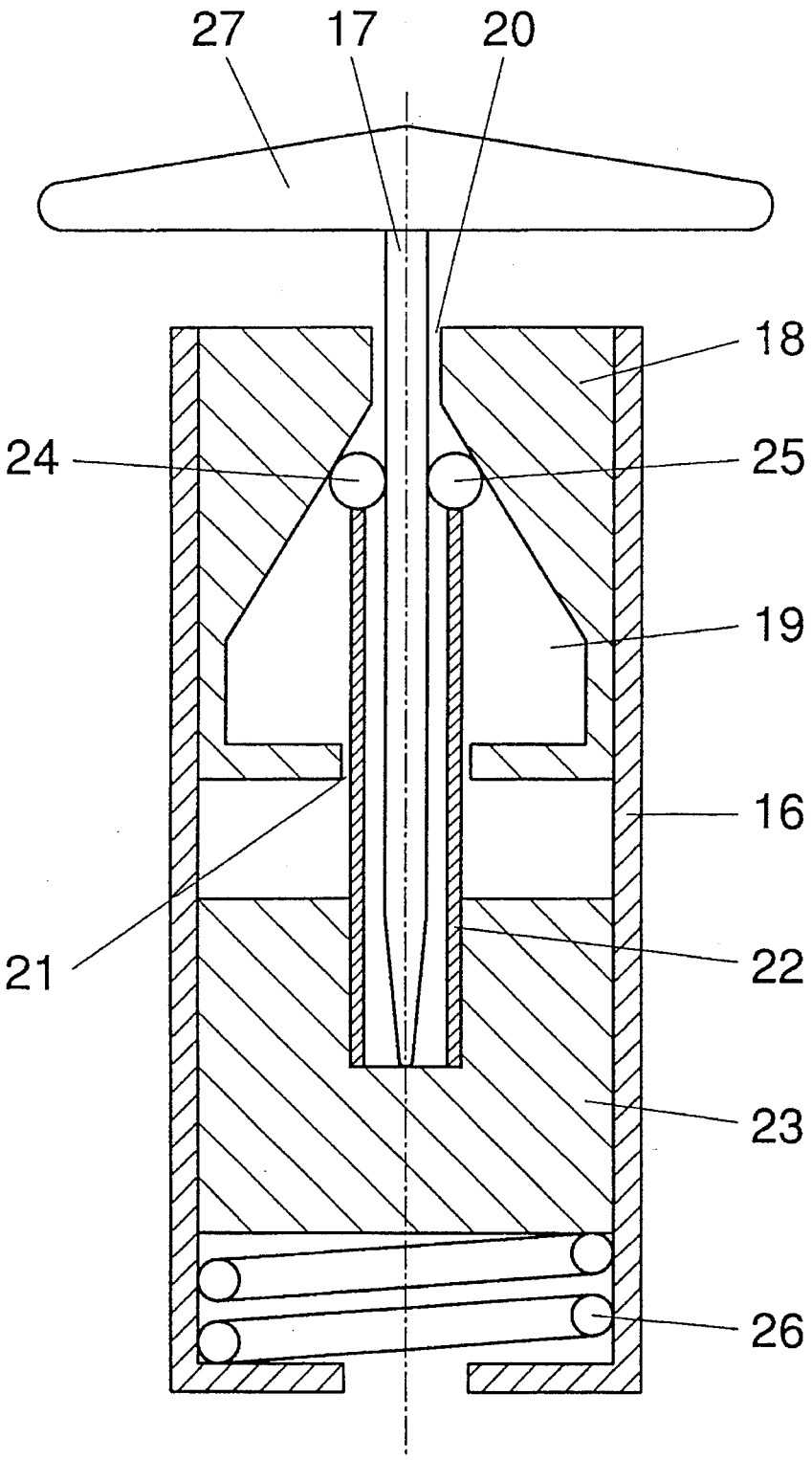
FIG. 6 shows a locking device located in a hollow base body which can have the metal strip disposed therearound.

FIG. 6 illustrates an article security element which has a tubular base body 16, inside which there can preferably be a locking device for a pin 17 with a button-shaped pinhead 27. A cylindrical body 18 with a conical cavity 19 can preferably be inserted in a fixed manner inside the base body 16 and can have a first round opening 20 for the pin 17 and a second round opening 21 on the side opposite the first opening 20 for a tubular holding body 22, which can be rigidly connected to a magnet 23 mounted so that it can move in the base body 16 in a direction along the longitudinal axis of the base body 16. The function of the magnet is to hold the balls 24 and 25, and by means of the force exerted by the spring 26 on the magnet 23, push the balls 24 and 25 into the conical taper of the conical cavity 19.

A pin inserted into the opening 20 pushes the balls 24 and 25, and thus also, by means of the locking body 22, the magnet 23, downward against the force of the spring 26. The pin 17 can thereby penetrate into the interior of the locking body 22.

If an attempt is made to remove the pin 17 from the locking device, the balls 24 and 25 can thereby be pulled into the conical taper of the conical cavity 19, which further increases their clamping action on the pin 17. Thus, the more tension which is exerted on the pin 17, the stronger the clamping action of the pin 17 between the balls 24 and 25.

By means of an unlocking magnet, separate from the body 16, and held against the article security element from below, the magnet 23 mounted so that it can move in the base body 16 and thus also the locking body 22, can be pulled downward, so that the balls 24 and 25 no longer exert a clamping action on the pin 17. The pin 17 can then be removed from the locking device, that is, as long as the unlocking magnet continues to act on the movable magnet 23. It should generally be understood that the unlocking magnet should have a magnetic attraction force with the magnet 23 that is stronger than the biasing force of the spring 26 to thereby overcome the biasing force of the spring 26.

Further examples of such pin locking mechanisms which can be used to secure such an anti-theft device to a garment, etc., can be found in the following U.S. Pat. Nos. 5,069,047 to John Lynch and Lincoln Charlot, entitled "Release of Pin-Clutch Mechanism in Theft-Deterrent Device"; and 5,022,244 to Lincoln Charlot, entitled "Pin-Clutch Mechanism for Theft-Deterrent Device".

One example of a typical scanning/detection field which could possibly be used in accordance with the present invention for detection of the security element as provided by the present invention can is disclosed by U.S. Pat. No. 3,665,449 which issued on May 23, 1972. In the described arrangement, a first circuit of the system applies an alternating magnetic field within a defined interrogation zone. The described field preferably has a peak magnitude of less than $127\times10^3$ Amp/meter, and is periodically alternating at a frequency within the audio range. When the magnetic strip is passed into the applied field, and a vector component of the field becomes oriented with a major dimension of the strip, the magnetization of the strip reverses at each alternation of the applied field. Each reversal of the magnetization produces a characteristic pulse of external magnetic field. A second circuit of the system is configured to detect the pulses, thus, verifying the presence of the strip in the field. The above configuration is meant as exemplary only, and it is submitted that one of ordinary skill in the art would be readily able to provide alternate scanning/detection fields which would be usable in the context of the present invention.

Some examples of materials, and configurations of which can be used for producing the magnetic strips which can be used in accordance with the present invention are disclosed in the above U.S. Pat. No. 3,665,449, as well as in the following U.S. Pat. Nos. 4,342,904 to Onsager and 4,298,862 to Gregor et al. In these particular references, one example of such a strip is comprised of a specialized ferromagnetic material such as permalloy which has a high permeability, e.g., greater than 0.125 tesla/Amp/meter and an aggregate saturation magnetic moment of at least $1.25\times10^{-10}$ weber-meters. Alternate materials can preferably be ductile strips of amorphous metal such as that manufactured by Allied Corporation under the name of "METGLAS". Some additional, more specific, examples of the high permeability, low coercive force ferromagnetic compositions which can possibly be used for manufacturing such a magnetic strip for use in the present invention are Allied Corporation products labelled "2826MB2" and "2705M". The materials listed above, are also meant as exemplary only, and it is also submitted that one of ordinary skill in the art would be readily familiar with alternative materials which could be used in the context of the present invention.

As disclosed by U.S. Pat. No. 3,665,449, a magnetic strip for use in such security devices as disclosed by the present invention preferably have preferred dimensions for being detectable in a type of scanning/detection field as described above. Such dimensions can preferably be selected such that there is a sufficiently large value for the ratio of length to the square root of the cross-sectional area. It has been determined that one particular configuration of dimensions provide such a ratio of at least 150, while alternative ratios may also be possible depending on the types of scanning/detection fields used. One example of a single strip of magnetic material which could be used has a length of about 7.6 cm, a width of about 1.6 mm and a thickness of about 0.02 inches, thereby providing a ratio of length to square root of cross-sectional area of about 425.

In view of the above, if a security device were manufactured in accordance with the present invention such that the base body had a length of about 8 cm, with a width and thickness of about 2 cm each, and an angle of alpha of about 45 degrees, approximately a 3 cm length of magnetic material could be disposed on each side of the base body. Therefore, if a magnetic material having a thickness of about 0.02 mm was used, the strip of magnetic material would preferably have a width of at least about 2 mm. Such a configuration is meant as exemplary only, and it is submitted that one of ordinary skill in the art would be readily able to determine the necessary dimensions needed to provide operable security elements in accordance with the present invention to meet specific dimensional requirements.

One feature of the invention resides broadly in the article security element (1, 9, 12, 13) having at least one soft magnetic metal strip (3, 7, 8, 11, 14, 15) which is wound in the shape of a helical line on an oblong, column-shaped base body (2, 10) made of non-magnetic material at an angle of pitch (alpha) which has a value between about 30 degrees and about 60 degrees.

Another feature of the invention resides broadly in the article security element, characterized by the fact that the angle of pitch (alpha) has a value between about 40 degrees and about 50 degrees, preferably about 45 degrees.

Yet another feature of the invention resides broadly in the article security element, characterized by the fact that the base body 2 is cylindrical.

Still another feature of the invention resides broadly in the article security element, characterized by the fact that the base body 16 is a hollow cylindrical body.

An additional feature of the invention resides broadly in the article security element, characterized by the fact that the base body 16 is tubular.

A further feature of the invention resides broadly in the article security element, characterized by the fact that the base body 10 is a rectangular solid.

Another feature of the invention resides broadly in the article security element, characterized by the fact that the magnetic strip winding (3, 11) has one turn.

Yet another feature of the invention resides broadly in the article security element, characterized by the fact that the magnetic strip winding consists of two half-turns (7, 8, 14, 15), which are wound onto the base body (2, 10) in opposite directions.

Still another feature of the invention resides broadly in the article security element, characterized by the fact that the base body 16 is a hollow body, inside which there is a locking device for a pin 17 for fastening the article security element to the article to be protected against theft.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Publication No. DE-OS P 43 08 740.7, having inventor Peter Lundberg, is hereby incorporated by reference as if set forth in its entirety herein.

The invention as described hereinabove in the context of the preferred embodiments is not to be taken as limited to all of the provided details thereof, since modifications and variations thereof may be made without departing from the spirit and scope of the invention.

What is claimed is:

1. An anti-theft device for use in a magnetic surveillance system for protecting an article from being stolen, the surveillance system including a transmitter for emitting magnetic energy along a detection axis and a receiver for detecting the energy, said anti-theft device comprising:

a base body, said base body having a longitudinal axis;

said base body comprising a non-magnetic material;

a perimeter surface disposed outward of and at least partially surrounding said longitudinal axis of said base body;

at least one strip of soft magnetic material disposed on said perimeter surface of said base body;

said at least one strip of soft magnetic material being disposed in a spiral on said perimeter surface transverse to said longitudinal axis at an angle of pitch of between about 30° and about 60° with respect to said longitudinal axis; and means for permitting fastening of said anti-theft device to the article to protect the article from being stolen.

2. The anti-theft device according to claim 1, wherein:

said angle of pitch is between about 40° and about 50°;

said base body comprises at least two adjoining sides defining at least a portion of said perimeter surface;

said at least one strip of soft magnetic material is helically disposed on at least said at least two adjoining sides; and the opposite terminal ends of said at least one strip of soft magnetic material are electrically disconnected from one another.

3. The anti-theft device according to claim 2, wherein:

said anti-theft device additionally comprises one of a) and b), where a) and b) are as follows:

a) a cylindrical base body;

said cylindrical base body having said longitudinal axis as a central axis of revolution thereof and said perimeter surface surrounding said central axis of revolution; and said at least one strip of soft magnetic material being helically disposed on said perimeter surface; and b) an elongated base body of substantially rectilinear cross section;

said elongated base body of substantially rectilinear cross section comprising at least three adjoining sides defining at least a portion of said perimeter surface;

said at least one soft magnetic strip comprising one of c) and d), where c) and d) are as follows:

c) a single strip of soft magnetic material disposed contiguously on said at least three adjoining sides; and d) two individual strips of soft magnetic material helically disposed in opposite directions on at least two adjoining sides of said at least three adjoining sides.

4. The anti-theft device according to claim 3, wherein:

said base body defines an interior cavity therein; and said base body comprises, within said interior cavity, at least a portion of said means for permitting fastening of said base body to the article.

5. The anti-theft device according to claim 4, wherein said means for permitting fastening of said base body to the article comprises:

pin means for being inserted through a portion of the article, said pin means comprising an elongated member having a first end for being inserted through said portion of the article and a second end opposite the first end, said second end of said pin means comprising cap means having a diameter sufficient for inhibiting the removal, by pulling, of said second end of said pin means through said portion of the article; and locking means disposed within said interior cavity, said locking means being configured for receiving and retaining said first end of said pin means therein.

6. The anti-theft device according to claim 5, wherein:

said non-magnetic material comprises plastic;

said soft magnetic material comprises at least one of:
a ferrite metal; and
a nickel iron alloy; and said locking means comprises:

a first member disposed within said interior cavity;

a second member disposed within said interior cavity;

means for displacing said second member between a first position and a second position, said first position being nearer to said first member than said second position;

biasing means for biasing said second member towards said first position, said biasing means exerting a biasing force for biasing said second member towards said first position;

said first member having a first end configured for receiving said first end of said pin means therethrough, and a second end disposed towards said second member;

said first member comprising a conical cavity having a narrow portion disposed adjacent said first end of said first member and a wider portion disposed adjacent said second end of said first member, said conical cavity having surfaces converging towards said first end of said first member;

said second member having a first end and a second end, said second end of said second member being opposite to said first end of said second member, and said first end of said second member comprising a protruding member extending into said conical cavity through said second end of said first member;

said protruding member having a first end disposed away from said second member;

said first end of said protruding member comprising means for grasping said first end of said pin means therebetween, said means for grasping being configured for contacting said cavity surfaces to be moved into engagement with said first end of said pin means as said protruding member is moved towards said first member, and out of engagement with said first end of said pin means as said protruding member is moved away from said first member;

said second member comprising a first magnet;

said second member being configured to be movable away from said first member to move said means for grasping out of engagement with said first end of said pin means by means of a second magnet disposed adjacent said second end of said second member, said second magnet having a magnetic attraction force for attracting said first magnet thereto; and said magnetic attraction force of said second magnet on said first magnet being greater than said biasing force exerted by said biasing means to overcome said biasing force and move said second member away from said first member.

7. The anti-theft device according to claim 1, wherein said base body comprises one of:

a cylindrical base body having said longitudinal axis as a central axis of revolution thereof, said perimeter surface surrounding said central axis of revolution; and an elongated base body of substantially rectilinear cross section comprising at least three adjoining sides defining at least a portion of said perimeter surface.

8. The anti-theft device according to claim 7, wherein said at least one strip of soft magnetic material is helically disposed on said perimeter surface of said base body.

9. The anti-theft device according to claim 8, wherein the opposite terminal ends of said at least one strip of soft magnetic material are electrically disconnected from one another.

10. The anti-theft device according to claim 9, wherein said perimeter surface comprises at least two perimeter surface portions;

said at least two perimeter surface portions being oriented substantially transversely with respect to one another; and wherein said at least one strip of soft magnetic material is disposed on each of said at least two perimeter surface portions.

11. An anti-theft device for use in a surveillance system for protecting an article from being stolen, the surveillance system including a transmitter for emitting energy and a receiver for detecting the energy, said anti-theft device comprising:

a base body having a longitudinal axis;

a perimeter surface disposed outward of and at least partially surrounding said longitudinal axis of said base body;

said base body comprising a non-magnetic material;

at least one strip of soft magnetic material disposed on said perimeter surface of said base body;

said at least one strip of soft magnetic material being disposed in a spiral on said perimeter surface transverse to said longitudinal axis; and means for permitting fastening of said anti-theft device to the article to protect the article from being stolen.

12. The anti-theft device according to claim 11, wherein:

said base body comprises an interior cavity formed therein; and said means for permitting fastening of said anti-theft device to the article comprises:

pin means for being inserted through a portion of the article, said pin means comprising an elongated member having a first end for being inserted through a portion of the article and a second end opposite said first end, said second end of said pin means comprising cap means having a diameter sufficient for inhibiting the removal, by pulling, of said second end of said pin means through the portion of the article; and locking means disposed within said interior cavity, said locking means being configured for receiving and retaining said first end of said pin means therein.

13. The anti-theft device according to claim 12, wherein:

at least a substantial portion of said at least one strip of soft magnetic material disposed in said spiral on said perimeter surface transverse to said longitudinal axis has an angle of pitch of between about 30° and about 60° with respect to said longitudinal axis;

the article comprises a retail article for being sold to a consumer;

said non-magnetic material comprises plastic; said soft magnetic material comprises at least one of:

a ferrite metal; and a nickel iron alloy; and said locking means comprises:

a first member disposed within said interior cavity;

a second member disposed within said interior cavity;

means for displacing said second member between a first position and a second position, said first position being nearer to said first member than said second position;

biasing means for biasing said second member towards said first position, said biasing means exerting a biasing force for biasing said second member towards said first position;

said first member having a first end configured for receiving said first end of said pin means therethrough, and a second end disposed towards said second member;

said first member comprising a conical cavity having a narrow portion disposed adjacent said first end of said first member and a wider portion disposed adjacent said second end of said first member, said conical cavity having surfaces converging towards said first end of said first, member;

said second member having a first end and a second end, said second end of said second member being opposite to said first end of said second member, and said first end of said second member comprising a protruding member extending into said conical cavity through said second end of said first member;

said protruding member having a first end disposed away from said second member;

said first end of said protruding member comprising means for grasping said first end of said pin means therebetween, said means for grasping being configured for contacting said cavity surfaces to be moved into engagement with said first end of said pin means as said protruding member is moved towards said first member, and out, of engagement with said first end of said pin means as said protruding member is moved away from said first member;

said second member comprising a first magnet;

said second member being configured to be movable away from said first member to move said means for grasping out of engagement with said first end of said pin means by means of a second magnet disposed adjacent said second end of said second member, said second magnet having a magnetic attraction force for attracting said first magnet thereto; and said magnetic attraction force of said second magnet on said first magnet being greater than said biasing force exerted by said biasing means to overcome said biasing force and move said second member away from said first member.

14. The anti-theft device according to claim 13, wherein a substantial portion of said at least one strip of soft magnetic material is oriented at an angle of pitch of between about 40° and about 50° with respect to said longitudinal axis.

15. The anti-theft device according to claim 14, wherein a substantial portion of said at least one strip of soft magnetic material is oriented at an angle of pitch of about 45° with respect to said longitudinal axis.

16. A method for protecting an article from being stolen, said method comprising the steps of:

providing means for detecting a magnetic field, said means for detecting a magnetic field being configured to detect a magnetic field in an area through which the article can be taken;

disposing an anti-theft device to accompany an article to be protected upon movement of the article;

configuring said anti-theft device to comprise:

a base body having a longitudinal axis;

a perimeter surface disposed outward of and at least partially surrounding said longitudinal axis of said base body;

said base body comprising a non-magnetic material;

at least one strip of soft magnetic material disposed on said perimeter surface of said base body;

said at least one strip of soft magnetic material being disposed in a spiral on said perimeter surface transverse to said longitudinal axis; and means for permitting fastening of said anti-theft device to the article to protect the article from being stolen.

17. The method according to claim 16, further comprising:

providing means for generating an alternating magnetic field, said means for generating an alternating magnetic field being configured to provide an alternating magnetic field in the area through which the article can be taken;

configuring said means for detecting to detect an alternating magnetic field different from the generated alternating magnetic field;

generating an alternating magnetic field in the area;

moving the protected article into the generated alternating field in the area;

detecting, upon entry of said anti-theft device into the generated alternating magnetic field, said alternating magnetic field different from the generated alternating magnetic field;

providing an interior cavity in said base body;

configuring said means for permitting fastening of said anti-theft device to comprise:

pin means for being inserted through a portion of the article, said pin means comprising an elongated member having a first end for being inserted through said portion of the article and a second end opposite said first end, said second end of said pin means comprising cap means having a diameter sufficient for inhibiting the removal, by pulling, of said second end of said pin means through the portion of the article; and locking means disposed within said interior cavity, said locking means being configured for receiving and retaining said first end of said pin means therein; and inserting said first end of said pin means through the portion of the article;

inserting said first end of said pin means into said locking means within said interior cavity; and locking said first end of said pin means in said locking means in said interior cavity.

18. The method according to claim 17, further comprising the steps of:

orienting at least a substantial portion of said at least one strip of soft magnetic material disposed in said spiral on said perimeter surface transverse to said longitudinal axis at an angle of pitch of between about 30° and about 60° with respect to said longitudinal axis;

using plastic as said non-magnetic material;

using, for said soft magnetic material, at least one of:

a ferrite metal; and a nickel iron alloy; configuring said locking means to comprise:

a first member disposed within said interior cavity;

a second member disposed within said interior cavity;

means for displacing said second member between a first position and a second position, said first position being nearer to said first member than said second position;

biasing means for biasing said second member towards said first position, said biasing means exerting a biasing force for biasing said second member towards said first position;

said first member having a first end configured for receiving said first end of said pin means therethrough, and a second end disposed towards said second member;

said first member comprising a conical cavity having a narrow portion disposed adjacent said first end of said first member and a wider portion disposed adjacent said second end of said first member, said conical cavity having surfaces converging towards said first end of said first member;

said second member having a first end and a second end, said second end of said second member being opposite to said first end of said second member, and said first end of said second member comprising a protruding member extending into said conical cavity through said second end of said first member;

said protruding member having a first end disposed away from said second member;

said first end of said protruding member comprising means for grasping said first end of said pin means therebetween, said means for grasping being configured for contacting said cavity surfaces to be moved into engagement with said first end of said pin means as said protruding member is moved towards said first member, and out of engagement with said first end of said pin means as said protruding member is moved away from said first member; said second member comprising a first magnet;

said second member being configured to be movable away from said first member to move said means for grasping out of engagement with said first end of said pin means by means of a second magnet disposed adjacent said second end of said second member, said second magnet having a magnetic attraction force for attracting said first magnet thereto; and said magnetic attraction force of said second magnet on said first magnet being greater than said biasing force exerted by said biasing means to overcome said biasing force and move said second member away from said first member;

inserting said first end of said pin means between said means for grasping;

biasing said means for grasping towards said first end of said first member;

grasping said pin means with said means for grasping; and to release said pin means from said body:

disposing said second magnet adjacent said second end of said second member;

overcoming said biasing force with said magnetic attraction force;

moving said second member away from said first member to release said grasping means; and withdrawing said pin means from said body.

19. The method according to claim 18, wherein said step of orienting at least a substantial portion of said at least one strip of soft magnetic material comprises the further step of orienting said substantial portion of said at least one strip of soft magnetic material at an angle of pitch between about 40° and about 50° with respect to said longitudinal axis.

20. The method according to claim 19, wherein said step of orienting at least a substantial portion of said at least one strip of soft magnetic material comprises the further step of orienting said substantial portion of said at least one strip of soft magnetic material at an angle of pitch of about 45° with respect to said longitudinal axis.

* * * * *